US007887042B2

(12) United States Patent
Sheng et al.

(10) Patent No.: US 7,887,042 B2
(45) Date of Patent: Feb. 15, 2011

(54) SEPARATION ROLLER AND SHEET SEPARATING MECHANISM USING THE SAME

(75) Inventors: Thomas Sheng, Hsinchu (TW); Chia-Huei Lin, Hsinchu (TW)

(73) Assignee: Avision Inc. (TW)

( * ) Notice: Subject to any disclaimer, the term of this patent is extended or adjusted under 35 U.S.C. 154(b) by 124 days.

(21) Appl. No.: 11/987,985

(22) Filed: Dec. 6, 2007

(65) Prior Publication Data

US 2008/0164651 A1 Jul. 10, 2008

(30) Foreign Application Priority Data

Jan. 5, 2007 (TW) ..... 96100398 A

(51) Int. Cl.
*B65H 3/52* (2006.01)

(52) U.S. Cl. ..... 271/121; 271/125

(58) Field of Classification Search ..... 271/109, 271/121, 122, 125
See application file for complete search history.

(56) References Cited

U.S. PATENT DOCUMENTS 4,801,134 A 1/1989 Yokoyama et al.
5,029,840 A * 7/1991 Haga et al. ..... 271/122
5,435,538 A 7/1995 Billings et al.
5,996,990 A * 12/1999 Kawashima ..... 271/122
6,139,006 A * 10/2000 Asada ..... 271/121
6,585,252 B1 * 7/2003 Russo et al. ..... 271/122
7,152,858 B2 * 12/2006 Lin ..... 271/117
7,461,841 B2 * 12/2008 Tanaka et al. ..... 271/312
2008/0099296 A1 * 5/2008 Sheng ..... 192/54.1

FOREIGN PATENT DOCUMENTS

JP 2004292125 10/2004
TW 575013 2/2004
TW I314100 9/2009

* cited by examiner

*Primary Examiner*—Kaitlin S Joerger

(57) ABSTRACT

A separation roller includes a body, a shaft assembly and two friction roller assemblies. The shaft assembly is connected to the body. The friction roller assembly is mounted on two ends of the shaft assembly and located on two sides of the body. The friction roller assembly contacts a sheet, and the body is separated from the sheet. The body provides a limiting torque to the friction roller assemblies through the shaft assembly to limit movement of the sheet. A sheet separating mechanism using the separation roller is also disclosed.

18 Claims, 9 Drawing Sheets

1 { 10, 20, 30 }

30 { 32, 32' }

20 { 22, 24 }

SEPARATION ROLLER AND SHEET SEPARATING MECHANISM USING THE SAME

BACKGROUND OF THE INVENTION

1. Field of Invention

The invention relates to a separation roller of a document or sheet feeder, and a sheet separating mechanism using the same, and more particularly to a miniaturized separation roller which can be easily replaced and repaired, and a sheet separating mechanism using the same.

2. Related Art

FIG. 1 is a schematic illustration showing a first conventional sheet separating mechanism. Referring to FIG. 1, the sheet separating mechanism includes a sheet transporting roller 101, a friction pad 102 and a spring 103. The sheet S is disposed between the sheet transporting roller 101 and the friction pad 102. The spring 103 presses the friction pad 102 in a direction toward the sheet transporting roller 101. Thus, when multiple sheets enter a passageway 104 between the sheet transporting roller 101 and the friction pad 102, the friction pad 102 stops the sheet S contacting therewith so that the sheet separating effect can be achieved. However, when a last sheet is being fed by this sheet separating mechanism, the sheet rubs against the friction pad 102 for a long period of time, and the sheet or the friction pad tends to be worn.

FIG. 2 is a schematic illustration showing a second conventional sheet separating mechanism. Referring to FIG. 2, the sheet separating mechanism includes a sheet transporting roller 201, a separation roller 202, a spring 203 and a torque limiter 204. The torque limiter 204 is mounted on a shaft assembly 205 and is disposed in the separation roller 202 to provide a torsional force to achieve the sheet separating effect. In this sheet separating mechanism, this separation roller 202 has to accommodate the torque limiter 204, so its size cannot be reduced. In addition, the processes of disassembling and assembling the torque limiter 204 are more complicated. Thus, the user or maintenance man feels inconvenient when he or she is replacing the separation roller 202.

In another conventional separation roller assembly, a separation roller frame is mounted on a shaft and connected to a torque limiter. The torque limiter connected to the separation roller provides a torsional force to achieve the sheet separating effect. However, the user or the maintenance man may feel inconvenient when he or she is replacing the separation roller. In addition, because the width of this separation roller assembly cannot be effectively shortened, the separation roller assembly cannot be miniaturized.

SUMMARY OF THE INVENTION

It is therefore an object of the invention to provide a miniaturized separation roller which can be conveniently repaired, and a sheet separating mechanism using the same.

The invention achieves the above-identified object by providing a separation roller including a body, a shaft assembly and two friction roller assemblies. The shaft assembly is connected to the body. The friction roller assemblies are mounted on the shaft assembly. The friction roller assemblies contact with a sheet. The body is separated from the sheet and provides a limiting torque to the friction roller assemblies through the shaft assembly to limit movement of the sheet.

The invention also provides a sheet separating mechanism assembled in a housing. The sheet separating mechanism includes a separation roller and a sheet transporting roller, and a pressure presses the separation roller in a direction toward the sheet transporting roller. The separation roller includes a body, a shaft assembly and two friction roller assemblies. The shaft assembly is connected to the body. The friction roller assemblies are mounted on the shaft assembly. The friction roller assemblies contact with a sheet. The body is separated from the sheet and provides a limiting torque to the friction roller assemblies through the shaft assembly to limit movement of the sheet. The sheet transporting roller is driven to rotate by a power source, and contacts with the friction roller assemblies to thus generate an external force, which is applied to the friction roller assemblies and tends to rotate the friction roller assembly.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
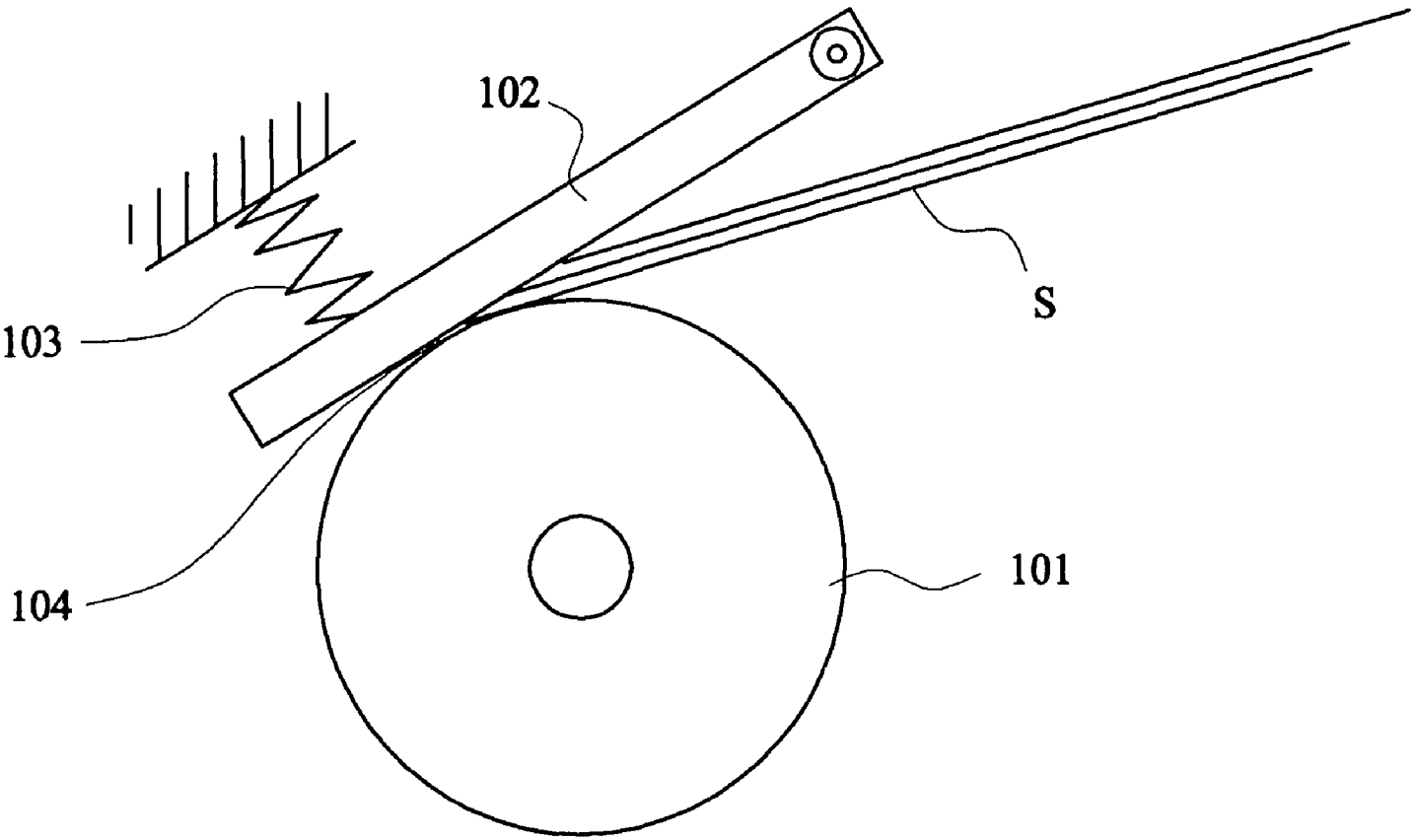
FIG. 1(Prior Art)
FIG. 1 is a schematic illustration showing a first conventional sheet separating mechanism.
Figure 2:
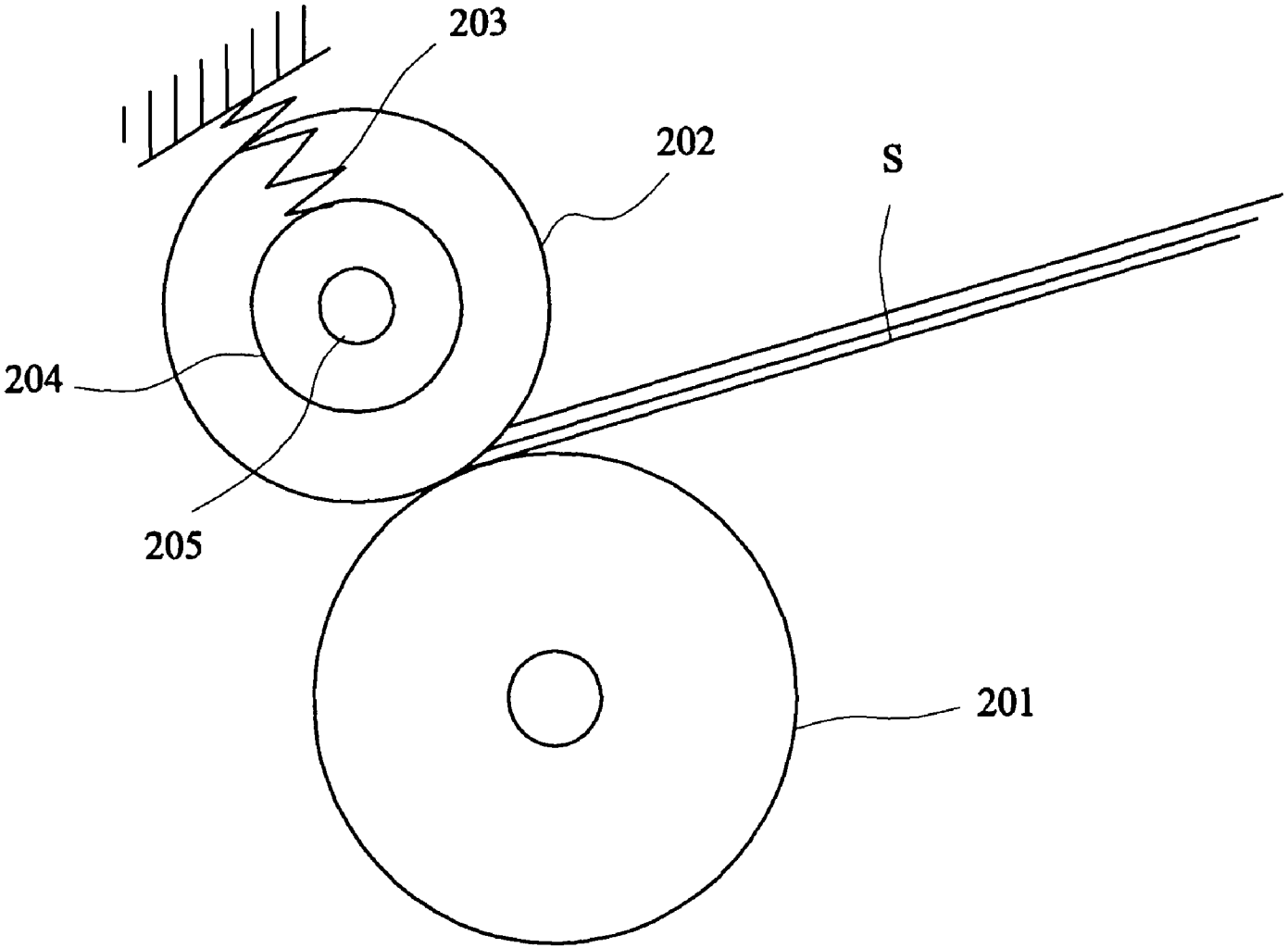
FIG. 2 (Prior Art)
FIG. 2 is a schematic illustration showing a second conventional sheet separating mechanism.
Figure 3:
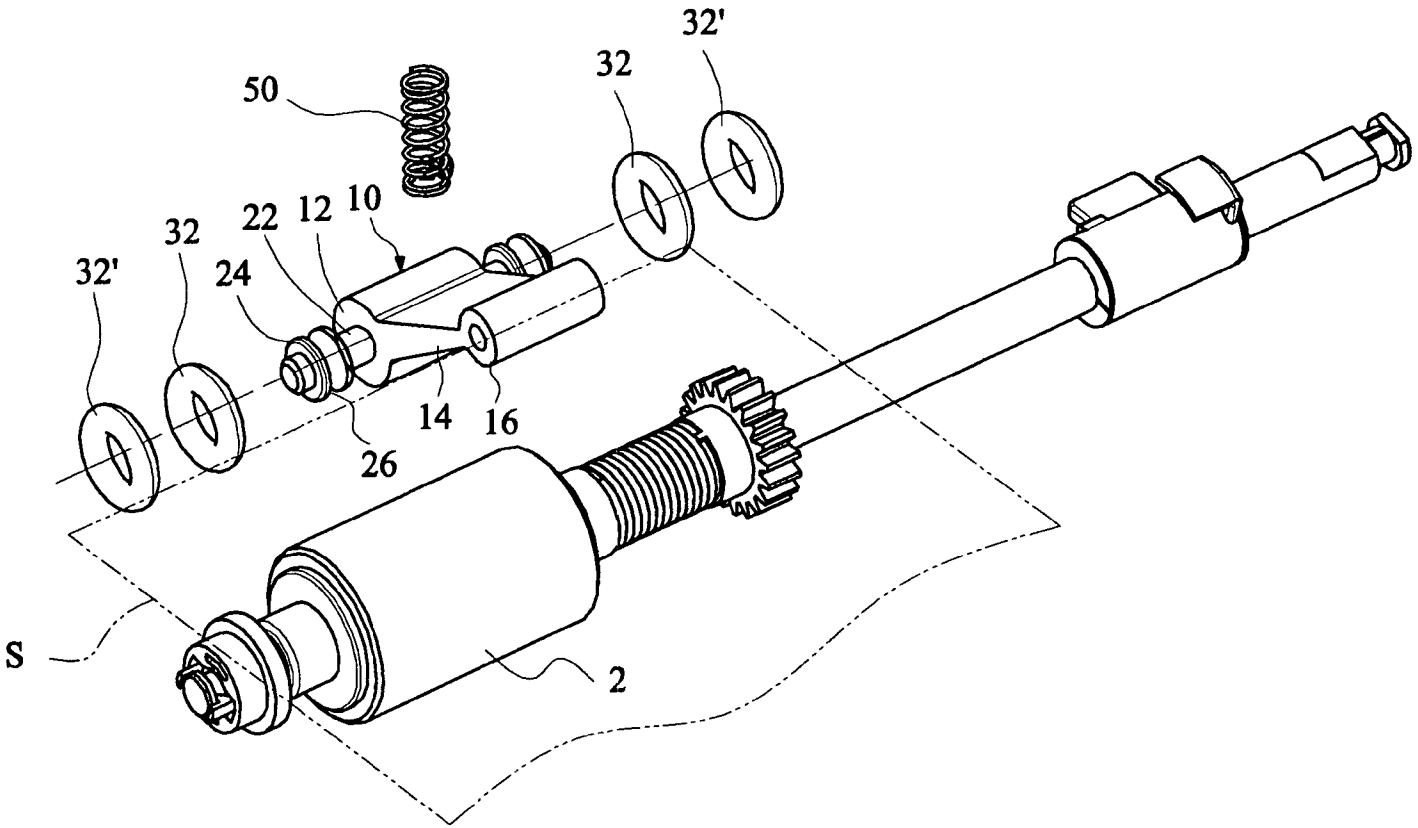
FIG. 3 is a pictorially exploded view showing a sheet separating mechanism according to a first embodiment of the invention.
Figure 4:
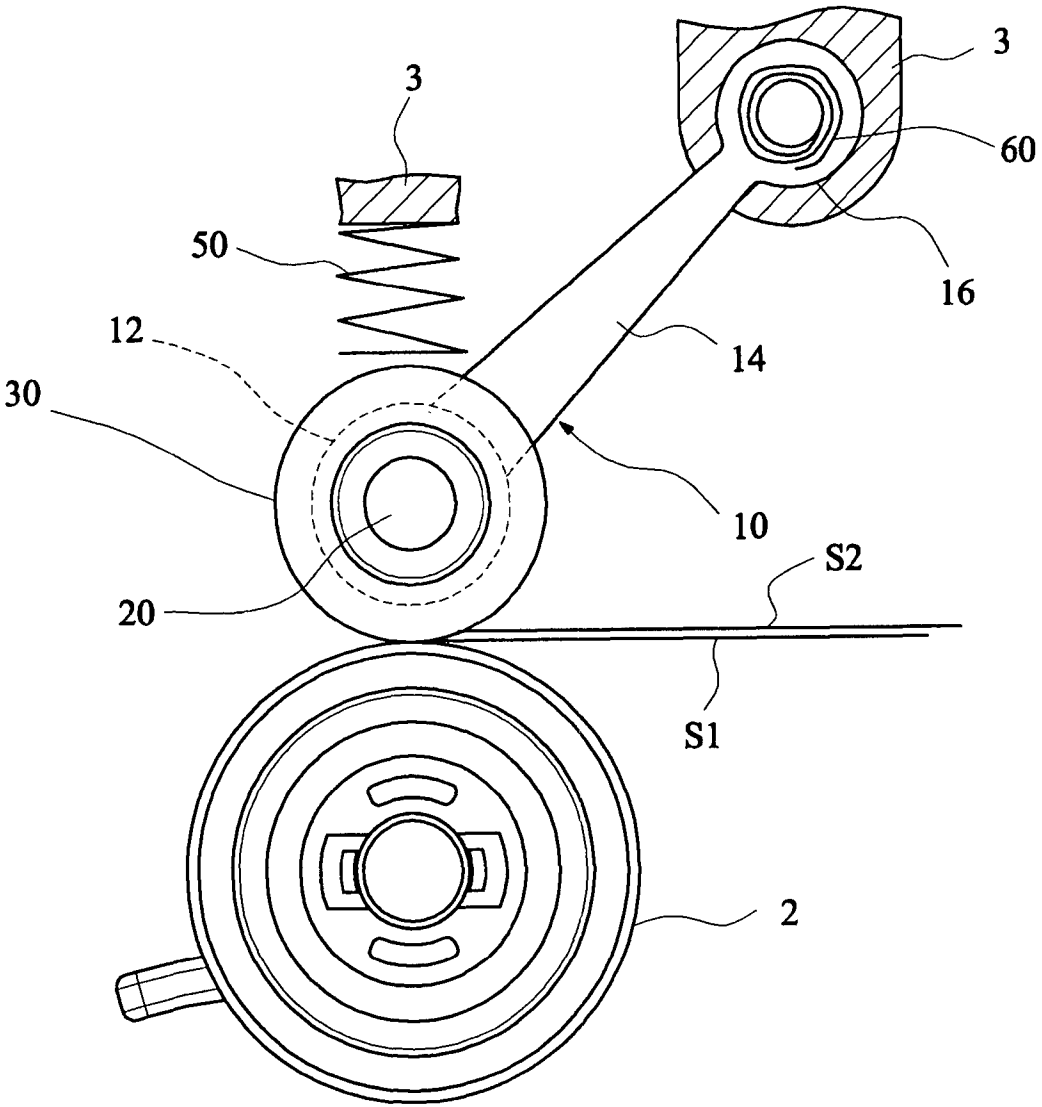
FIG. 4 is a side view showing the sheet separating mechanism according to the first embodiment of the invention.
Figure 5:
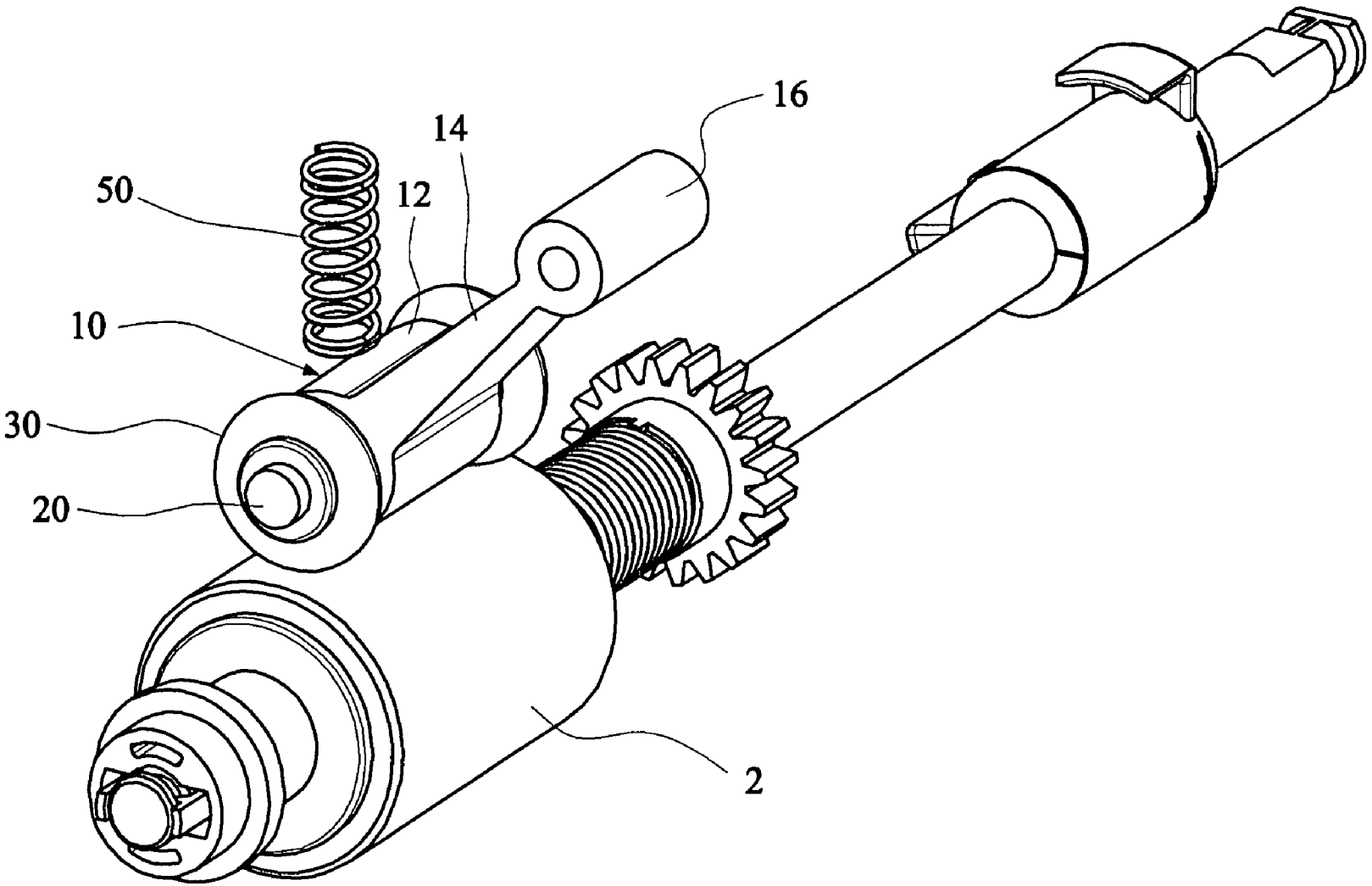
FIG. 5 is a pictorially assembled view showing the sheet separating mechanism according to the first embodiment of the invention.

FIGS. 3 to 5 are respectively pictorially exploded view, side view and pictorially assembled view showing a sheet separating mechanism according to a first embodiment of the invention. As shown in FIGS. 3 to 5, the sheet separating mechanism of the invention is assembled in a housing 3 and includes a sheet transporting roller 2 and a separation roller 1. The separation roller 1 includes a body 10, a shaft assembly 20 and two friction roller assemblies 30.

The body 10 may be referred to as a separation roller frame. The body 10 includes a cylindrical portion 12, an arm 14 and a pivoting portion 16. The cylindrical portion 12 may be a cylinder, a rectangular column or any other column and is connected to the shaft assembly 20. The arm 14 is connected to the cylindrical portion 12. The pivoting portion 16 connected to the arm 14 is to be pivotally connected to the housing 3 to serve as a fulcrum for the swinging of the arm 14. The housing 3 may be a housing of an automatic document feeder, for example. The pivoting portion 16 may also be replaced with any other structure to achieve the desired function of the separation roller.

The shaft assembly 20 connected to the body 10 includes a shaft 22 and two adapters 24 respectively mounted on two ends of the shaft 22. The two friction roller assemblies 30 are respectively mounted on the two adapters 24. The shaft assembly 20 may be connected to the body 10 in various ways. In one example, the body 10 and the shaft assembly 20 are two elements, which are separated from and stationary relative to each other. The shaft assembly 20 is rotatable relative to the friction roller assemblies 30, and the limiting torque is generated between the shaft assembly 20 and the friction roller assemblies 30. In another example, the body 10 and the shaft assembly 20 are integrally formed, the shaft assembly 20 is rotatable relative to the friction roller assemblies 30, and the limiting torque is generated between the shaft assembly 20 and the friction roller assemblies 30. In still another example, the shaft assembly 20 is stationary relative to the friction roller assemblies 30, the body 10 is rotatable relative to the shaft assembly 20, and the limiting torque is generated between the body 10 and the shaft assembly 20. In yet still another example, the shaft assembly 20 is rotatable relative to the friction roller assemblies 30, and the body 10 is also rotatable relative to the shaft assembly 20. Thus, the limiting torque is generated between the shaft assembly 20 and the friction roller assemblies 30 and between the body 10 and the shaft assembly 20. The limiting torque may be generated through a friction force, a damping force, an electromagnetic force or the like.

The friction roller assemblies 30 are respectively mounted on two ends of the shaft assembly 20 and located on two sides of the body 10. In this embodiment, the friction roller assemblies 30 include four friction rollers 32 and 32' respectively disposed at the two ends of the shaft assembly 20, wherein the friction rollers 32 and 32' are mounted on one adapter 24, which may be made of a plastic material. The friction roller 32' is disposed adjacent to the friction roller 32 and for providing an effect of assisting the friction roller 32.

Figure 6:
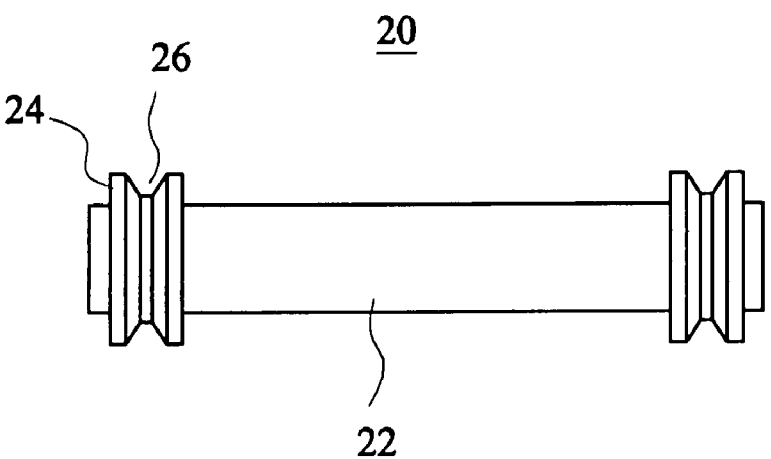
FIG. 6 is a schematic illustration showing an example of a shaft assembly according to the invention.

It is to be noted that the object and the effect of the invention still can be achieved after the structure of the invention has been properly adjusted. For example, the widths of the friction rollers 32 and 32' can be enlarged, the friction rollers 32' or the adapters 24 on the two ends of the shaft assembly 20 may be omitted, or the number of the friction rollers mounted on one adapter can be increased. The friction roller 32 may be mounted on a circumferential surface or an annular groove 26 of the adapter 24, as shown in FIG. 6.

Figure 7:
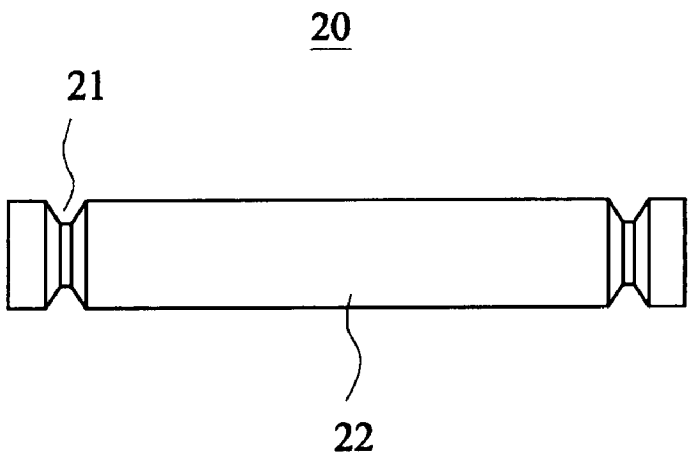
FIG. 7 is a schematic illustration showing another example of the shaft assembly according to the invention.

It is to be noted that the adapter 24 may also be omitted, as shown in FIG. 7. In this case, the friction roller 32 is mounted on an annular groove 21 formed on one end of the shaft assembly 20, as shown in FIG. 7. The friction roller may be an elastic ring, a non-elastic ring or an O-ring or a typical rubber wheel having the smaller rim width and the lower manufacturing cost. The friction rollers are respectively mounted on the two ends of the shaft assembly 20, wherein one outer diameter of the friction roller is greater than an outer diameter of the cylindrical portion 12, and the two friction rollers contact with the sheet transporting roller 2. Thus, the friction roller assembly 30 may include an O-ring or a rubber wheel.

The friction roller assemblies 30 contact with a sheet S. The body 10 is separated from the sheet S, and the body 10 provides the limiting torque to the friction roller assembly 30 through the shaft assembly 20 to limit movement of the sheet S.

The sheet transporting roller 2 is driven to rotate by a power source, such as a motor, and contacts with the friction roller assemblies 30 to thus generate an external force, which is applied to the friction roller assemblies 30 and the shaft assembly 20 and tends to rotate the friction roller assemblies 30 and the shaft assembly 20.

In order to achieve the sheet separating effect, the separation roller 1 has to be forced to press against the sheet transporting roller 2. Therefore, a pressure has to be provided to press the separation roller 1 in a direction toward the sheet transporting roller 2. In one example, the self weigh of the separation roller 1 may make the separation roller 1 press against the sheet transporting roller 2. Alternatively, the sheet separating mechanism may further include a compression spring 50, which contacts with the separation roller 1, is mounted to the housing 3 of the sheet separating mechanism, and is applying the pressure to press the separation roller 1 in a direction toward the sheet transporting roller 2.

Figure 8:
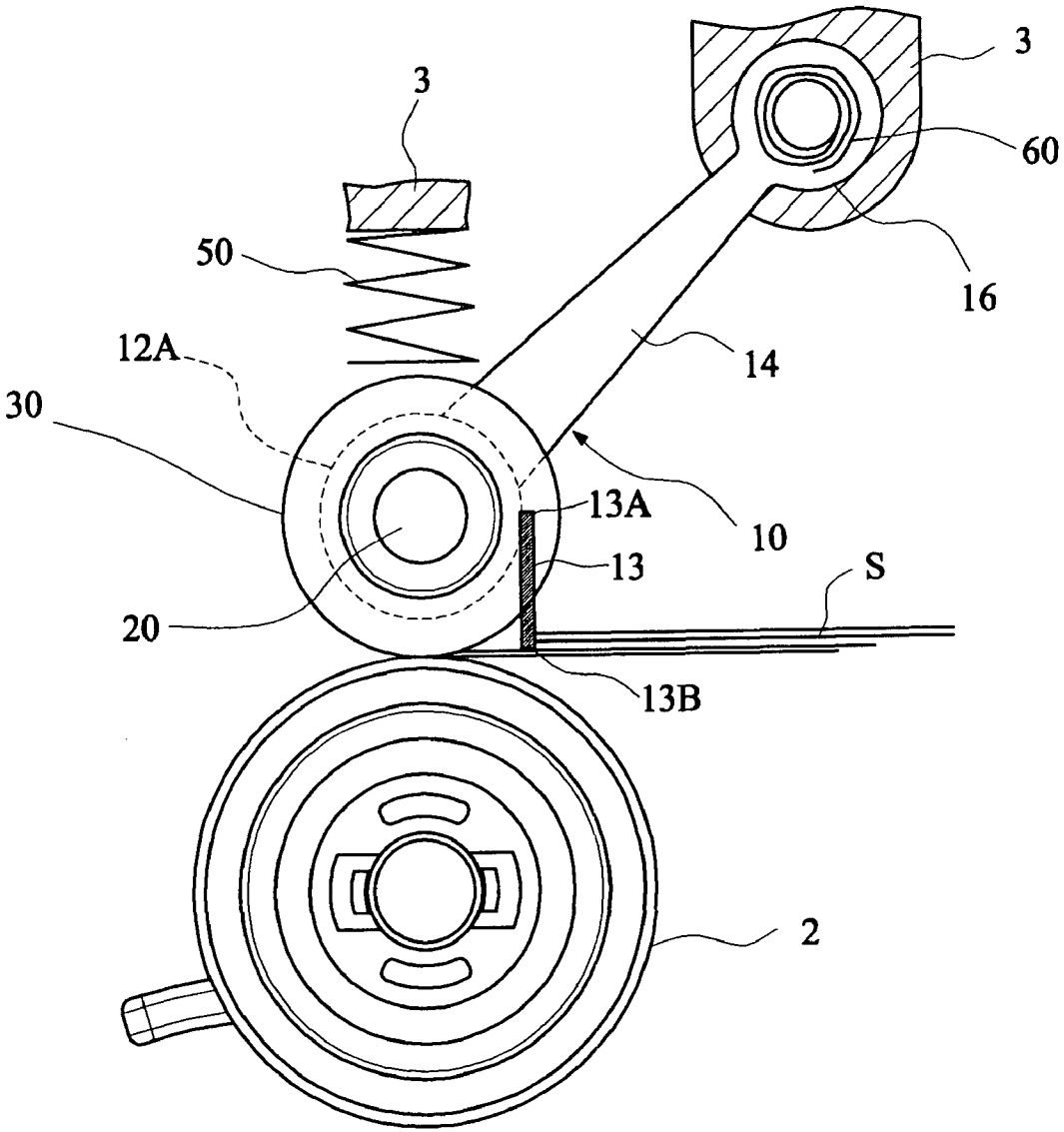
FIG. 8 is a side view showing a sheet separating mechanism according to a second embodiment of the invention.

In addition to the above-mentioned pressing method, a torsional spring 60 connected to the pivoting portion 16 and the housing 3 may also be adopted to apply a torsional force to the arm 14 and thus to apply the pressure to press the separation roller 1 in a direction toward the sheet transporting roller 2, as shown in FIG. 8. Alternatively, the arm 14 itself is an elastomer or includes an elastic member. Thus, the pressure may be applied to press the friction roller assembly 30 of the separation roller 1 in a direction toward the sheet transporting roller 2 according to the elasticity of the arm 14 and the self weight of the separation roller 1.

How the sheet separating mechanism of the invention can achieve the sheet separating effect will be described with reference to FIG. 4. The sheet transporting roller 2 is rotated to rotate the friction roller assemblies 30 of the separation roller 1. It is assumed that two sheets S1 and S2 simultaneously enter the passageway between the separation roller 1 and the sheet transporting roller 2. At this time, the sheet transporting roller 2 contacts with the sheet S1, and the friction roller assemblies 30 contact with the sheet S2. The sheet transporting roller 2 continuously moves the sheet S1 forward according to the friction force between the sheet transporting roller 2 and the sheet S1. Whether the friction roller assemblies 30 rotate is determined according to the force of the sheet S1 for moving the friction roller assemblies 30 through the sheet S2. The limiting torque is such that it is greater than the force of the sheet S1 for rotating the friction roller assemblies 30 through the sheet S2 but is smaller than the force of the sheet transporting roller 2 for rotating the friction roller assemblies 30. Thus, the sheet S2 is fixed by the friction roller assemblies 30 or the sheet S2 is moved back and forced by the friction roller assemblies 30 according to an energy storage mechanism, which is achieved by, for example the elasticity of each friction roller assembly 30, so that the sheet S1 slides relative to the sheet S2 to prevent the sheet S2 from entering the sheet passageway and thus to achieve the sheet separating effect.

FIG. 8 is a side view showing a sheet separating mechanism according to a second embodiment of the invention. As shown in FIG. 8, the sheet separating mechanism of this embodiment further includes a sheet stopping element 13, such as a sheet stopping pad, having opposite first and second ends 13A and 13B. The first end 13A is mounted on an outer surface 12A of the cylindrical portion 12 parallel to the shaft assembly 20, and the second end 13B is kept free and extends in a direction toward the sheet transporting roller 2, wherein the second end 13B may directly contact with or may be separated from the sheet transporting roller 2. The sheet stopping element mainly functions to stop a few sheets S before the sheet separating operation in order to increase the efficiency of the sheet separating mechanism. That is, the sheet stopping element blocks at least one sheet S from entering the passageway between the separation roller 1 and the sheet transporting roller 2.

Figure 9:
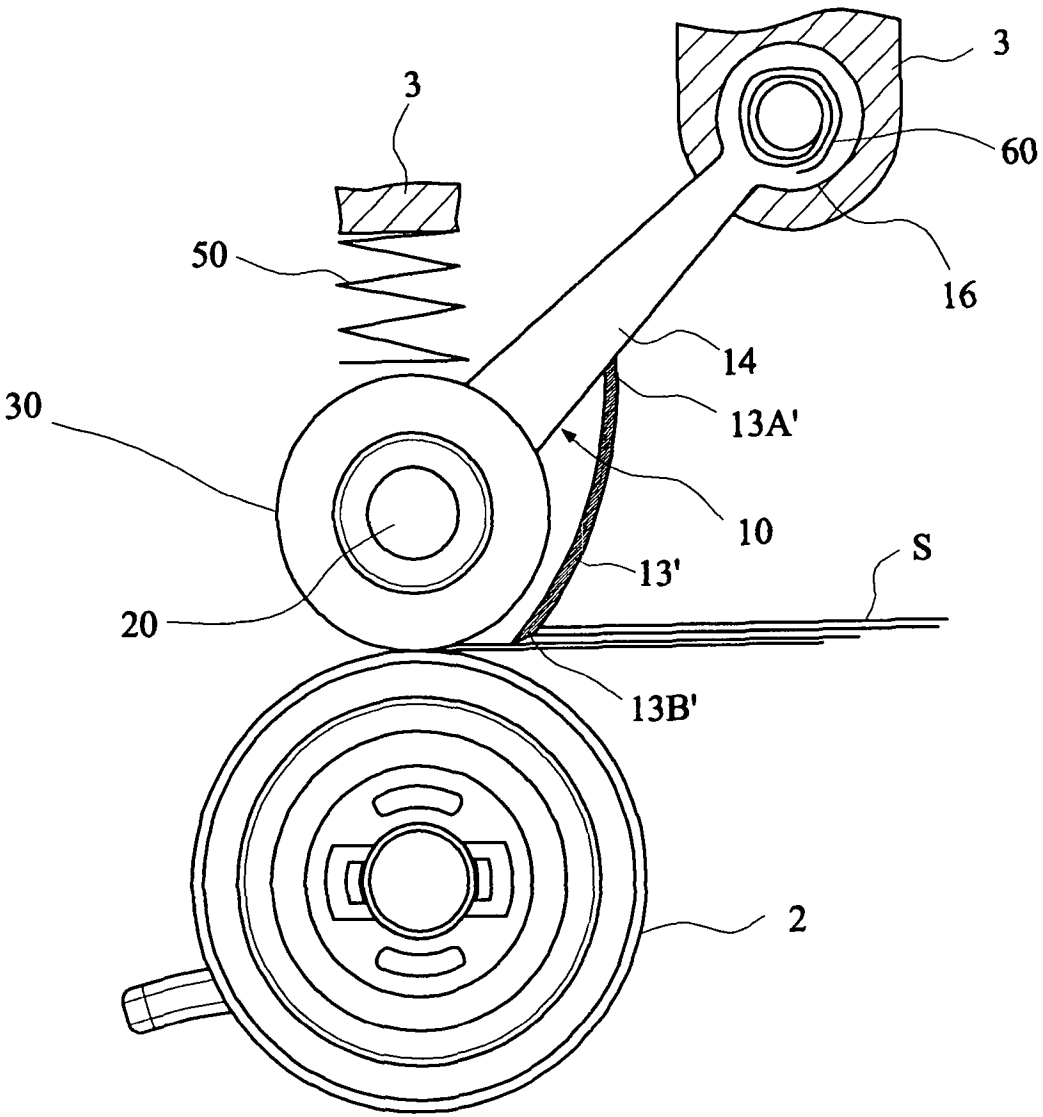
FIG. 9 is a side view showing a sheet separating mechanism according to a third embodiment of the invention.

FIG. 9 is a side view showing a sheet separating mechanism according to a third embodiment of the invention. As shown in FIG. 9, the separation roller 1 of this embodiment further includes a sheet stopping element 13' having opposite first and second ends 13A' and 13B'. The first end 13A' is mounted on the arm 14, and the second end 13B' is kept free and extends in a direction toward the sheet transporting roller 2. The sheet stopping element blocks at least one sheet S from entering the passageway between the separation roller 1 and the sheet transporting roller 2 when multiple sheets are being fed.

Figure 10:
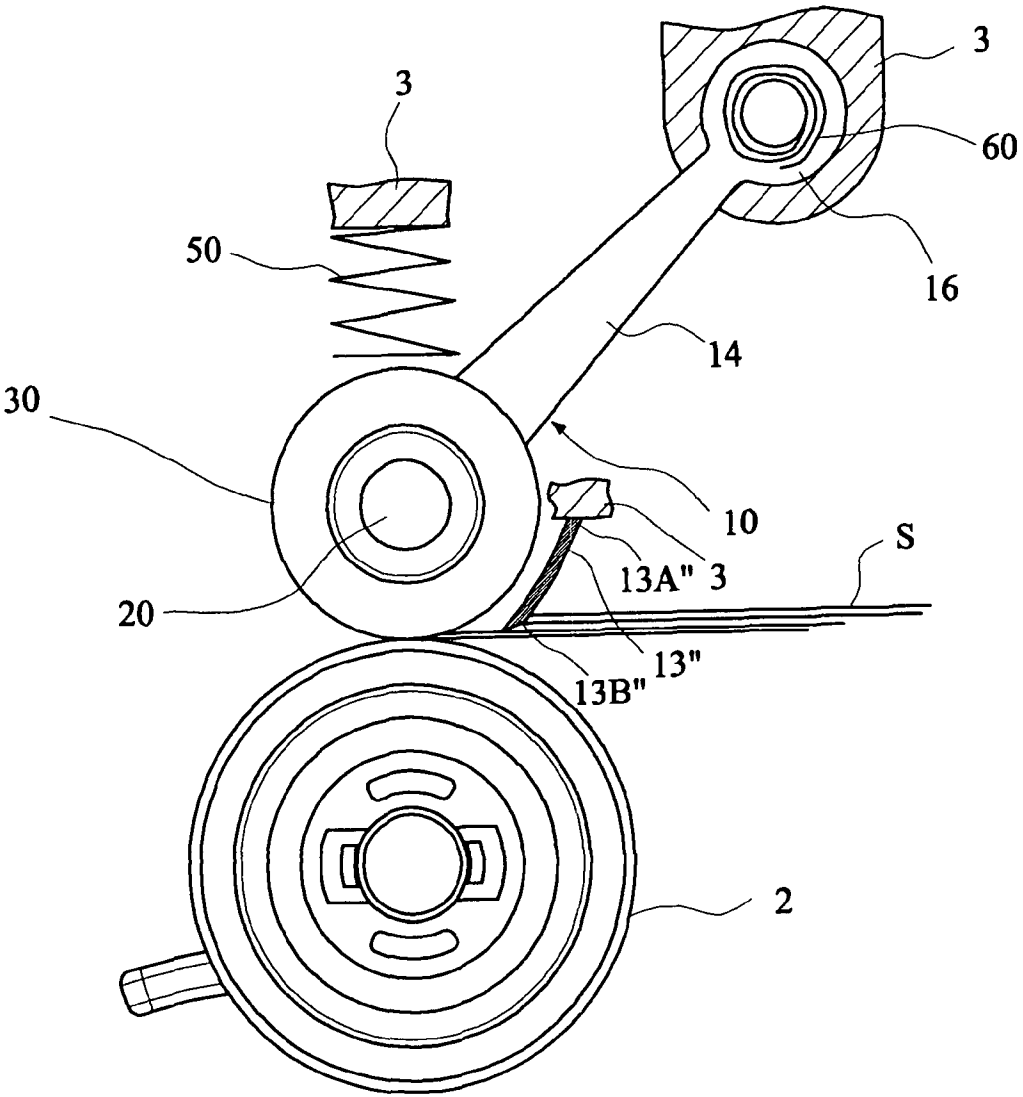
FIG. 10 is a side view showing a sheet separating mechanism according to a fourth embodiment of the invention.

FIG. 10 is a side view showing a sheet separating mechanism according to a fourth embodiment of the invention. Referring to FIG. 10, the sheet separating mechanism of this embodiment further includes a sheet stopping element 13" having opposite first and second ends 13A" and 13B". The first end 13A" is mounted on the arm 14. The second end 13B" is kept free and extends in a direction toward the sheet transporting roller 2, and may directly contact with or be separated from the sheet transporting roller 2. Similarly, the sheet stopping element blocks at least one sheet S from entering the passageway between the separation roller 1 and the sheet transporting roller 2 when multiple sheets are being fed.

In this sheet separating mechanism of the invention, the outer diameter of the friction roller assembly 30 is greater than that of the cylindrical portion 12. So, the cylindrical portion 12 cannot directly contact with the sheet transporting roller 2, and only the friction roller assemblies 30 directly contact with the sheet transporting roller 2. Consequently, only the friction roller assemblies 30 are worn and need to be replaced. When the friction roller assemblies 30 need to be replaced, no complicated steps are needed. Instead, only the friction roller assemblies 30 need to be removed from the two ends of the shaft assembly 20 and the new friction roller assemblies 30 can be mounted on the two ends. When the friction rollers are O-rings, no disassembling tool is needed, and the O-rings can be removed according to the elasticity thereof. In addition, the shaft assembly 20 can be directly mounted to the cylindrical portion, so the outer diameter of the overall separation roller can be effectively reduced.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A separation roller, comprising:

a body;

a shaft assembly connected to the body; and two friction roller assemblies, which are mounted on two ends of the shaft assembly and located on two sides of the body and in contact with a sheet, wherein the body is separated from the sheet, the body provides a limiting torque to the friction roller assemblies through the shaft assembly to limit movement of the sheet, the body and the shaft assembly are stationary relative to each other, the shaft assembly is rotatable relative to the friction roller assemblies, and the limiting torque is generated between the shaft assembly and the friction roller assemblies.

2. The separation roller according to claim 1, wherein the shaft assembly comprises a shaft and two adapters respectively mounted on two ends of the shaft, and the two friction roller assemblies are respectively mounted on the two adapters.

3. The separation roller according to claim 1, wherein each of the friction roller assemblies includes an O-ring.

4. The separation roller according to claim 1, wherein the body comprises:

a cylindrical portion connected to the shaft assembly; and an arm connected to the cylindrical portion.

5. The separation roller according to claim 4, further comprising a sheet stopping element having opposite first and second ends, wherein the first end is mounted on an outer surface of the cylindrical portion parallel to the shaft assembly, and the second end is kept free.

6. The separation roller according to claim 4, further comprising a sheet stopping element having opposite first and second ends, wherein the first end is mounted on the arm and the second end is kept free.

7. The separation roller according to claim 1, wherein the body comprises:

a cylindrical portion connected to the shaft assembly;

an arm connected to the cylindrical portion; and a pivoting portion connected to the arm.

8. A sheet separating mechanism to be assembled in a housing, the sheet separating mechanism comprising:

a separation roller, which comprises:

a body;

a shaft assembly connected to the body; and two friction roller assemblies mounted on two ends of the shaft assembly and located on two sides of the body, wherein the friction roller assemblies contact with a sheet; and a sheet transporting roller, which is driven to rotate by a power source and contacts with the friction roller assemblies to generate an external force, which is applied to the friction roller assemblies and tends to rotate the friction roller assemblies, wherein a pressure presses the separation roller in a direction toward the sheet transporting roller, the body, without touching the sheet, provides a limiting torque to the friction roller assemblies through the shaft assembly to limit movement of the sheet, the body is stationary relative to the shaft assembly, the shaft assembly is rotatable relative to the friction roller assemblies, and the limiting torque is generated between the shaft assembly and the friction roller assemblies.

9. The sheet separating mechanism according to claim 8, further comprising:

a compression spring, contacting with the separation roller, for applying the pressure to press the separation roller in the direction toward the sheet transporting roller.

10. The sheet separating mechanism according to claim 8, wherein the shaft assembly comprises a shaft and two adapters respectively mounted on two ends of the shaft, and the two friction roller assemblies are respectively mounted on the two adapters.

11. The sheet separating mechanism according to claim 8, wherein each of the friction roller assemblies comprises an O-ring.

12. The sheet separating mechanism according to claim 8, wherein the body comprises:

a cylindrical portion connected to the shaft assembly; and an arm connected to the cylindrical portion.

13. The sheet separating mechanism according to claim 12, further comprising a sheet stopping element having opposite first and second ends, the first end is mounted on an outer surface of the cylindrical portion parallel to the shaft assembly, and the second end is kept free and extends in the direction toward the sheet transporting roller.

14. The sheet separating mechanism according to claim 12, further comprising a sheet stopping element having opposite first and second ends, the first end is mounted on the arm and the second end is kept free and extends in the direction toward the sheet transporting roller.

15. The sheet separating mechanism according to claim 12, further comprising a sheet stopping element having opposite first and second ends, the first end is mounted on the arm and the second end is kept free and extends in the direction toward the sheet transporting roller.

16. The sheet separating mechanism according to claim 8, wherein the body comprises:

a cylindrical portion connected to the shaft assembly;

an arm connected to the cylindrical portion; and a pivoting portion connected to the arm and pivotally connected to the housing.

17. The sheet separating mechanism according to claim 16, further comprising:

a torsional spring, connected to the housing, for applying the pressure to the arm to press the separation roller in the direction toward the sheet transporting roller.

18. The sheet separating mechanism according to claim 17, wherein the arm comprises an elastic member, and the arm applies the pressure to press the separation roller in the direction toward the sheet transporting roller.

* * * * *